US007188443B2

(12) United States Patent
Collida et al.

(10) Patent No.: US 7,188,443 B2
(45) Date of Patent: Mar. 13, 2007

(54) CHARM DISPLAY APPARATUS AND METHOD OF CHARM DISPLAY

(75) Inventors: Karl A. Collida, 81 Elaine Dr., O'Fallon, MO (US) 63366; Edwin T. Wood, O'Fallon, MO (US)

(73) Assignee: Karl A. Collida, Lake St. Louis, MO (US)

( * ) Notice: Subject to any disclaimer, the term of this patent is extended or adjusted under 35 U.S.C. 154(b) by 11 days.

(21) Appl. No.: 10/440,971

(22) Filed: May 19, 2003

(65) Prior Publication Data

US 2003/0217490 A1 Nov. 27, 2003

Related U.S. Application Data

(60) Provisional application No. 60/382,041, filed on May 21, 2002.

(51) Int. Cl.
*G09F 19/00* (2006.01)

(52) U.S. Cl. ..... 40/406; 40/410

(58) Field of Classification Search ..... 40/406, 40/409, 410, 412; 446/176, 179; 221/24, 221/281

See application file for complete search history.

(56) References Cited

U.S. PATENT DOCUMENTS

| | | | | | |
|---|---|---|---|---|---|
| RE13,875 | E | * | 2/1915 | Rotherham | 40/409 |
| 2,361,346 | A | * | 10/1944 | Atkins | 40/409 |
| 2,621,042 | A | * | 12/1952 | Stein et al. | 273/144 R |
| 3,415,513 | A | * | 12/1968 | Burnbaum | 472/65 |
| 3,905,140 | A | * | 9/1975 | Damiano | 40/409 |
| 4,028,830 | A | * | 6/1977 | Ottinger | 40/410 |
| 4,976,376 | A | * | 12/1990 | Williams | 221/24 |
| 5,412,888 | A | * | 5/1995 | Rickuss et al. | 40/410 |
| 5,426,877 | A | * | 6/1995 | Lin | 40/406 |
| 5,794,364 | A | * | 8/1998 | Richmond | 40/406 |
| 5,919,078 | A | * | 7/1999 | Cassidy | 446/479 |
| 6,256,911 | B1 | * | 7/2001 | Duarte Vieira | 40/406 |

* cited by examiner

*Primary Examiner*—Joanne Silbermann
(74) *Attorney, Agent, or Firm*—Kevin L. Klug

(57) ABSTRACT

A charm display apparatus and method of charm display capable of continuously retrieving charms or hearts from a hopper and blowing or moving the charms into a transparent outer display tube whereby a levitating effect is shown. In the preferred embodiment, the art of the present invention allows a person to retrieve a charm between the display tube and the hopper as it flutters in the turbulent air of the tube under gravitational force. Also in a preferred embodiment, a unique venturi flow generator assembly is utilized to move the charms from the hopper into the outer display tube.

5 Claims, 13 Drawing Sheets

CHARM DISPLAY APPARATUS AND METHOD OF CHARM DISPLAY

This application claims priority of U.S. Provisional Patent Application No. 60/382,041, filed May 21, 2002.

BACKGROUND OF THE INVENTION

This invention relates in general to charm display machines and more particularly to a unique charm display machine capable of pneumatically levitating or directing charms or toy hearts within a visual display field. The art of the present invention may operate and function in conjunction with or apart from a fiber stuffing and fluffing machine.

Applicants have described a stuffing and fluffing machine in pending U.S. and international applications, entitled "Fiber Stuffing and Fluffing Machine", the art of which is often used in conjunction with the present art. Frequently, the aforementioned "Fiber Stuffing and Fluffing Machine" is used to fiber stuff toy animals such as teddy bears for children. Often the aforementioned is used in locations such as malls and shopping centers where children are able to watch and observe the toy animal stuffing procedure. Often a small charm such as a small fabric stuffed heart is available to the observing children for placement within the stuffed animal before or after stuffing and before sealing or closure of the animal is accomplished. Typically said charms are small, palm sized or less, and lightweight. Traditionally said charms or hearts are available in a bulk receptacle for retrieval by a child for which the stuffed animal is being prepared. The present art presents a machine and apparatus which levitates or pneumatically blows said charms or hearts within a column for visual and interactive presentation to the observing children and further allows a child to manually catch a charm or heart as it flutters downward toward an opening.

The machine of the present invention essentially comprises an outer exhaust tube, preferably of a clear transparent or translucent material, an inner exhaust tube which feeds the outer exhaust tube, a flow generator assembly, and a charm hopper receptacle having an open top which substantially surrounds said flow generator assembly. Preferably, said flow generator assembly comprises a venturi having a pressurized air inlet, a deflection plate, an inlet tube, and an agitator assembly comprising an agitator and motor. All of the aforementioned are mounted as further described on or with a display stand.

The charms or hearts are blown into said outer exhaust tube from said inner exhaust tube and flutter downward due to the effect of gravity. The length of the outer exhaust tube is sufficient to provide a display area to view "fluttering" charms. When pressurized, the charms or hearts generally cannot reenter the inner exhaust tube due to the positive air flow pressure exiting therefrom.

The inner exhaust tube preferably connects with, is fed by, and held by said flow generator assembly. The venturi is mounted within said flow generator assembly and feeds the first inner exhaust tube end with a pressurized air and charm/heart flow combination.

Once fully energized the venturi suctions charms or hearts from said charm hopper, blows them into said inner exhaust tube, thereby allowing the charms or hearts to enter the outer exhaust tube. As said charms or hearts lose velocity, they begin to fall under the influence of gravity in a fluttering fashion. A person may collect one or more charms or hearts at the gap between charm hopper opening and the first outer tube end when energized. If not collected, the charms or hearts enter the charm hopper, are collected, and re-enter the flow generator assembly to repeat the aforesaid process.

Accordingly, it is an object of the present invention to provide a charm display machine which levitates or pneumatically blows charms within a column for visual and interactive presentation to an observer.

Another object of the present invention is to provide a charm display machine which allows a person to manually catch and retrieve a charm as it flutters downward toward an opening.

A further object of the present invention is to provide a charm display machine having a storage hopper for charms which is easily accessible and easily filled with charms or hearts.

A still further object of the present invention is to provide a method of charm display which is visually appealing.

A still further object of the present invention is to provide a method of charm display which allows easy and convenient access to charms for catching or retrieving purposes.

SUMMARY OF THE INVENTION

To accomplish the foregoing and other objects of this invention there is provided a charm display apparatus and method of charm display for displaying and allowing easy access to charms. The device and its associated method of practice is particularly useful for displaying and accessing charms in conjunction with a fiber stuffing machine.

The present art presents a machine and apparatus which levitates or pneumatically blows said charms or hearts within a column for visual and interactive presentation to the observing children (or other persons) and further allows a child to manually catch a charm or heart as it flutters downward toward an opening. Although the preferred embodiment is designed to function with typically palm size or smaller charms, alternative embodiments may function with charms of any size provided the essential components of the apparatus described herein are designed to accommodate said size.

The machine of the present invention essentially comprises an outer exhaust tube, preferably of a clear transparent or translucent material, an inner exhaust tube which feeds the outer exhaust tube, a flow generator assembly, and a charm hopper receptacle having an open top which substantially surrounds said flow generator assembly. Said flow generator assembly preferably comprises a venturi having a pressurized air inlet, a deflection plate, an inlet tube, and an agitator assembly comprising an agitator and motor. All of the aforementioned are mounted as further described on or with a display stand.

The outer exhaust tube is preferably cylindrical in shape. Preferably, said outer exhaust tube lengthwise axis is mounted in a vertical orientation which is substantially parallel with the gravitational force. The charms or hearts are blown into said outer exhaust tube toward said second exhaust tube end from said inner exhaust tube and flutter downward due to the effect of gravity. The length of the outer exhaust tube is sufficient to provide a display area to view "fluttering" charms.

The outer exhaust tube end is preferably mounted above the charm hopper opening whereby a child may manually catch a charm or heart as it flutters downward toward the charm hopper opening. That is, the opening or gap between the outer exhaust tube end and the charm hopper opening allows a child (or other person) to safely insert a hand and catch a falling charm or heart as it flutters downward under gravitational force. Charms or hearts which are not manually captured at said opening or gap fall through said charm hopper opening and back into the charm hopper whereby they begin the process of being re-blown into the outer exhaust tube.

A second inner exhaust tube is preferably positioned slightly within said first outer exhaust tube end, but may be placed substantially within or outside said outer exhaust tube provided said charms or hearts enter said outer exhaust tube due to the positive pressure from said inner exhaust tube. The length of penetration of the inner exhaust tube within said outer exhaust tube allows the pressure of the exhaust air from the flow generator assembly to suspend a quantity of charms in a fluttering type manner.

The inner exhaust tube preferably connects with, is fed by, and held by said flow generator assembly. Said flow generator assembly allows charms or hearts which fall into said charm hopper to be suctioned into said flow generator assembly and re-enter the display process.

Said agitator assembly slowly rotates to minimize the possibility of charms or hearts clogging the flow generator assembly. Alternative embodiments may not utilize said agitator assembly, or may place said agitator and motor at different locations, or may utilize other methods to prevent clogging of said flow generator assembly such as vibrating mechanisms, screening mechanisms, or blowing mechanisms without departing from the present art.

In operation a person presses an energizing button which energizes an electropneumatic valve which allows compressed air to flow to said flow generator assembly. (The present invention presupposes an available supply of compressed air.) Said button also energizes the agitator assembly. Once fully energized the flow generator assembly or venturi suctions charms or hearts from said charm hopper, blows them into said inner exhaust tube, thereby allowing the charms or hearts to enter the outer exhaust tube with a velocity great enough to approach and fill said second outer tube. As said charms or hearts lose velocity, they begin to fall under the influence of gravity in a fluttering fashion. A person may collect one or more charms or hearts at the gap between charm hopper opening and the first outer tube when energized. If not collected, the charms or hearts enter the charm hopper, are collected, and re-enter the flow generator assembly to repeat the aforesaid process. When de-energized, the fluttering charms fall or drop from the outer exhaust tube into the charm hopper. As described, the charm display machine and its associated apparatus function as an interactive display for presentation of the charms or hearts to the person collecting them.

The aforedescribed charm display machine and its associated apparatus may be manufactured from a variety of materials which are capable of withstanding the pressures, forces, and wear involved. This includes but is not limited to plastics, ferrous and non ferrous metals and alloys thereof, composite materials, ceramics, and various types of wood. The associated valves and motor may be powered from any conventional AC or DC power supply provided the components are rated for the supply used. In the preferred embodiment said electropneumatic valve and motor is powered with conventional 120 volt, 60 cycle, AC power.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
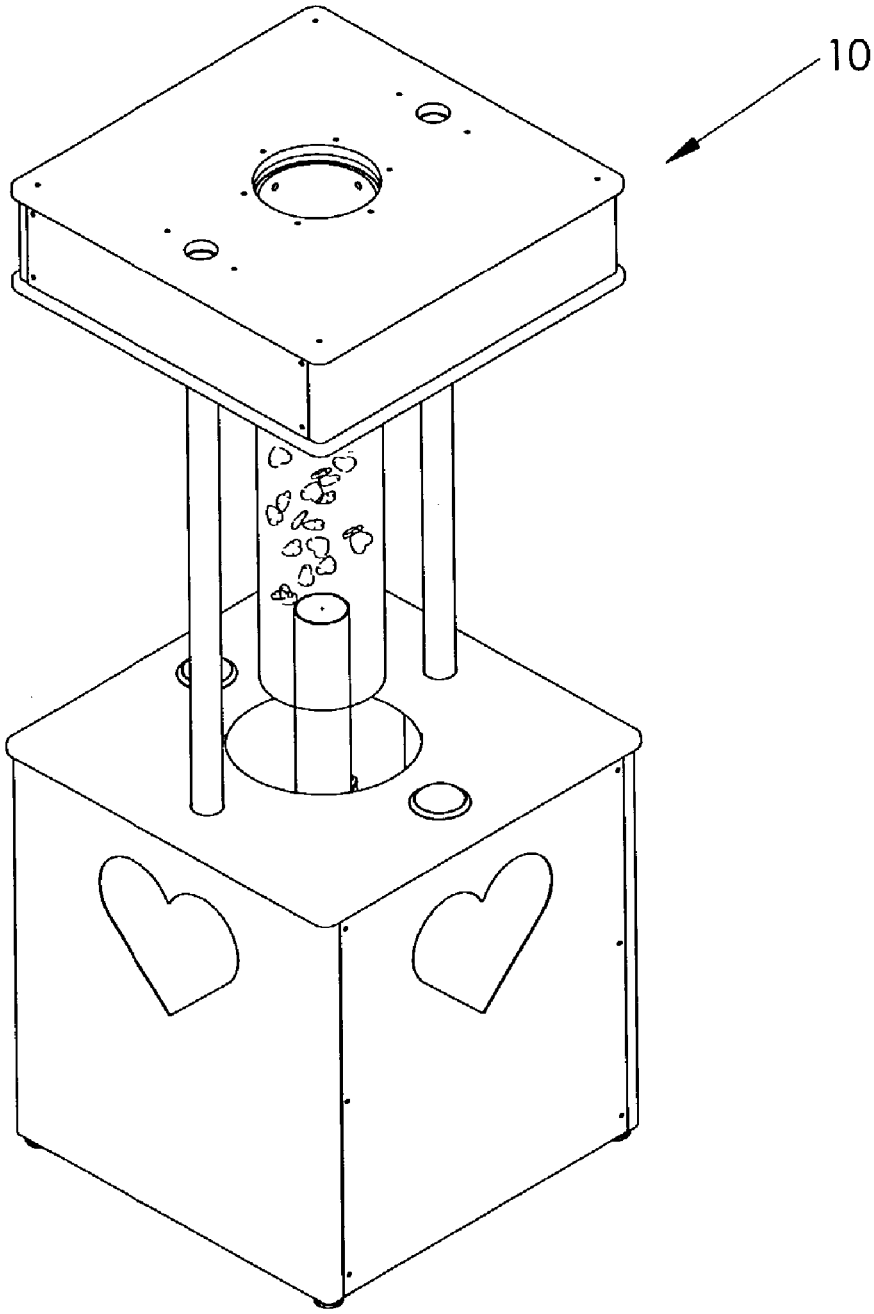
FIG. 1 shows a perspective view of the charm display machine with fluttering charms.
Figure 2:
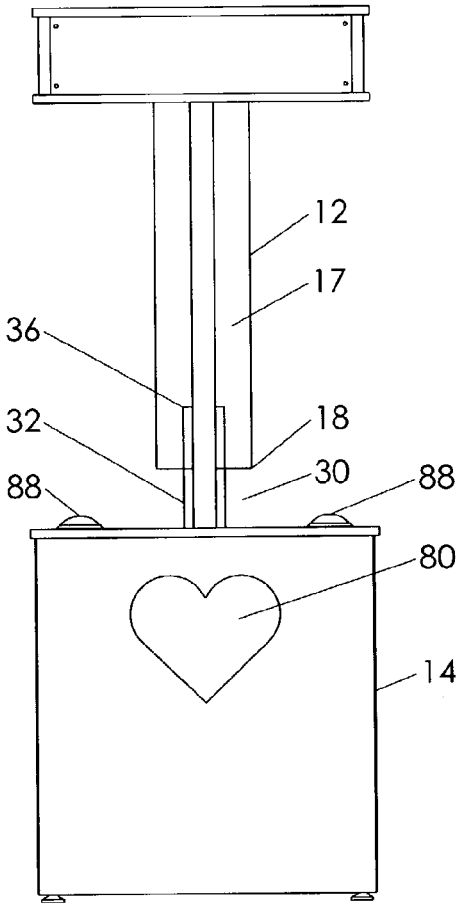
FIG. 2 shows left side plan view of the charm display machine which is symmetric with a right side plan view.
Figure 3:
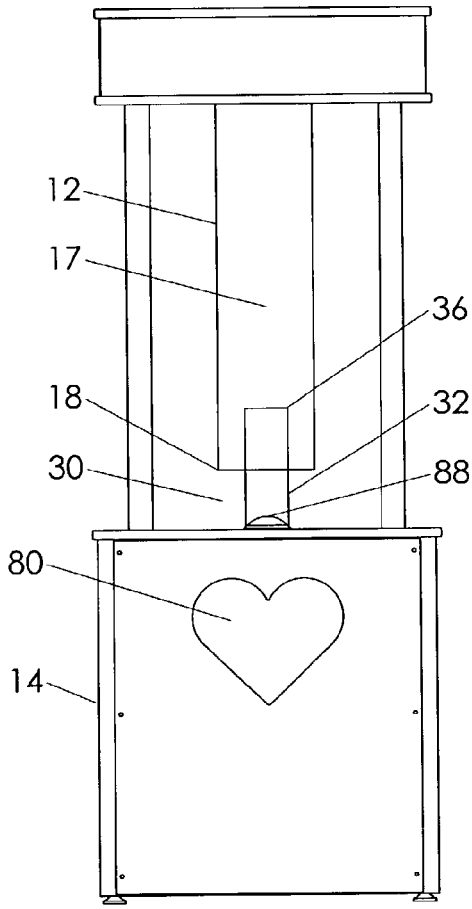
FIG. 3 shows a front side plan view of the charm display machine which is symmetric with a rear side plan view.
Figure 4:
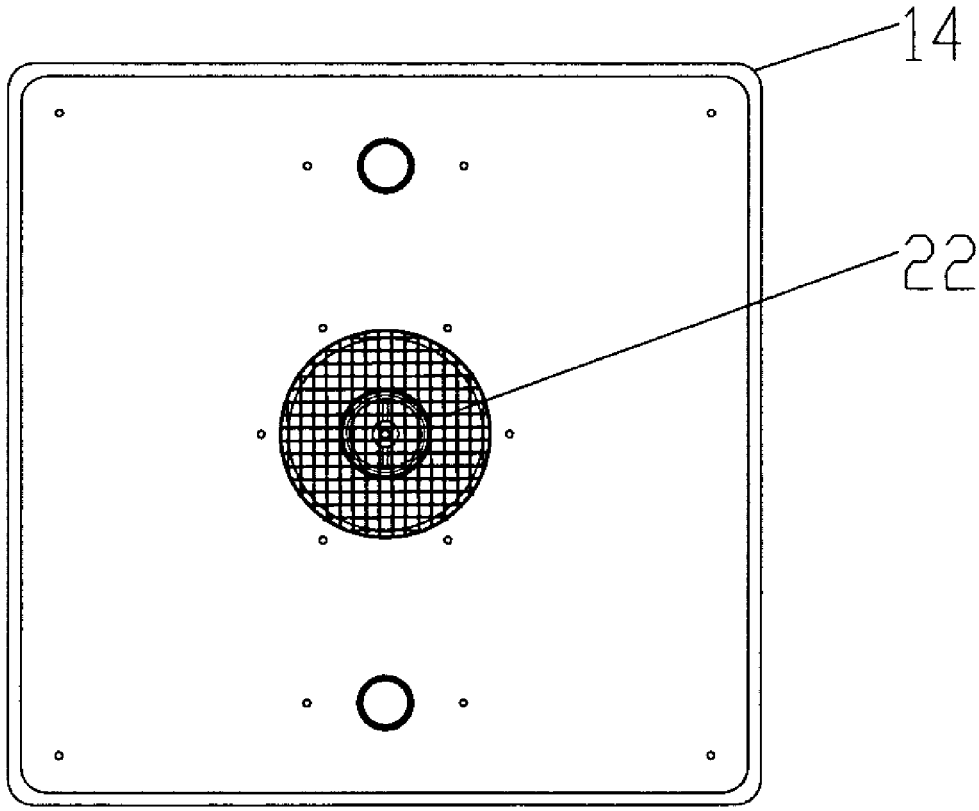
FIG. 4 shows top side plan view of the charm display machine.
Figure 5:
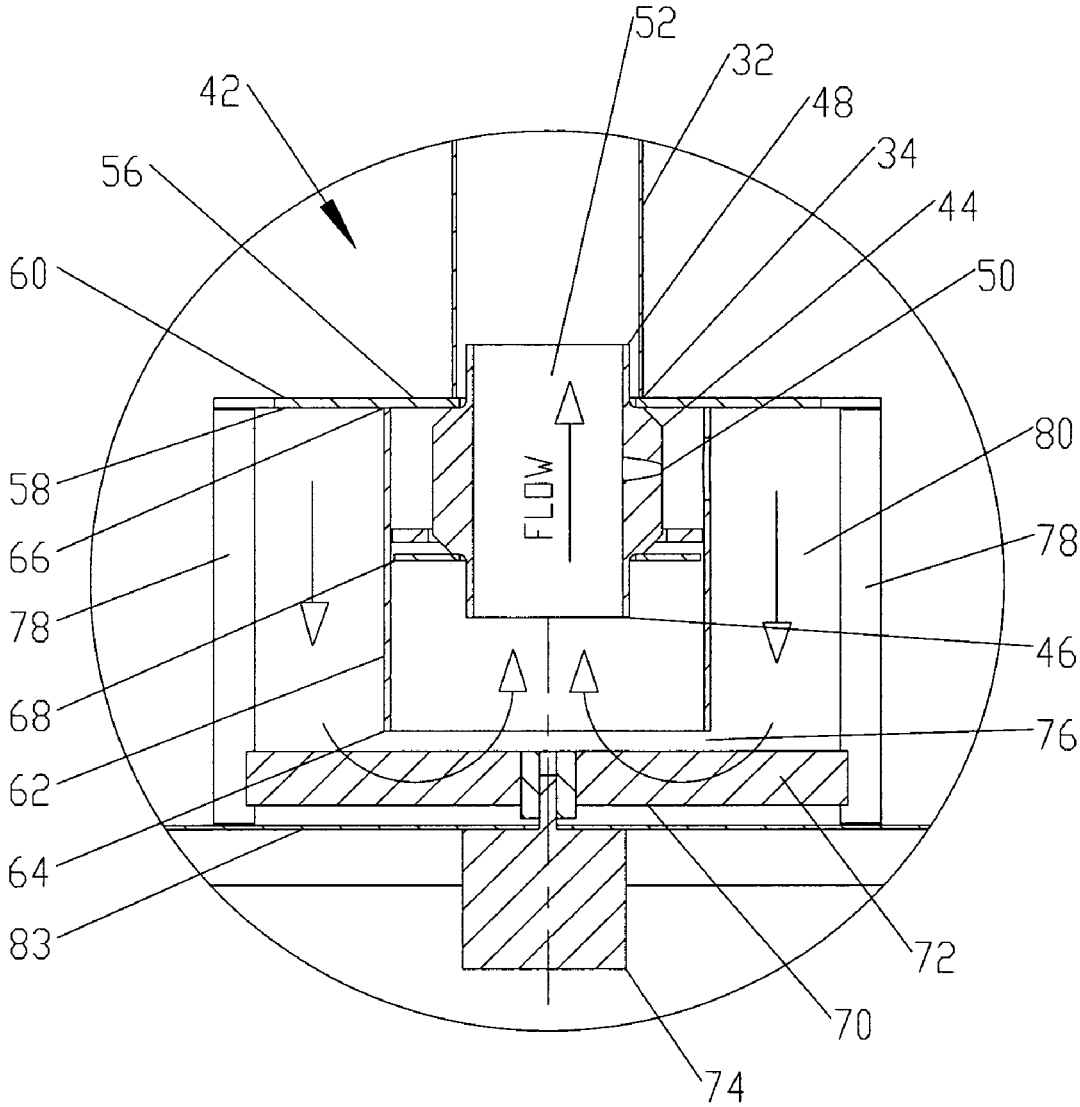
FIG. 5 shows an exploded cross sectional view of the flow generator assembly shown in FIG. 7 as encirclement "B".
Figure 6:
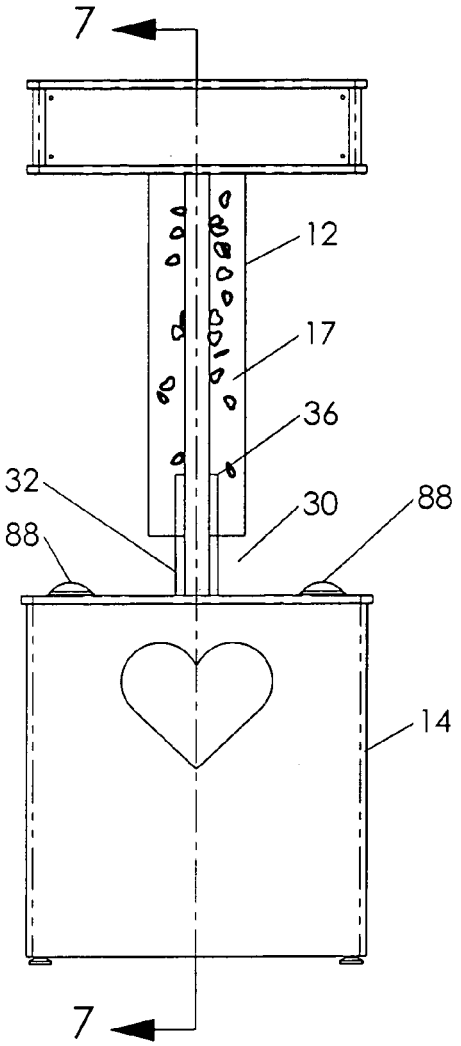
FIG. 6 shows a left side plan view of the charm display machine with the cross sectional cut line A—A and with fluttering charms.
Figure 7:
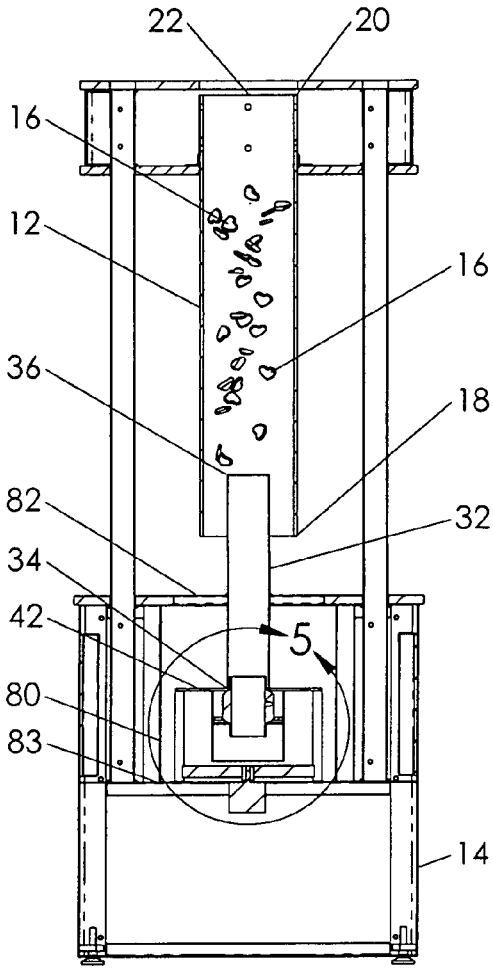
FIG. 7 shows a front cross sectional view along line A—A of FIG. 6.
Figure 8:
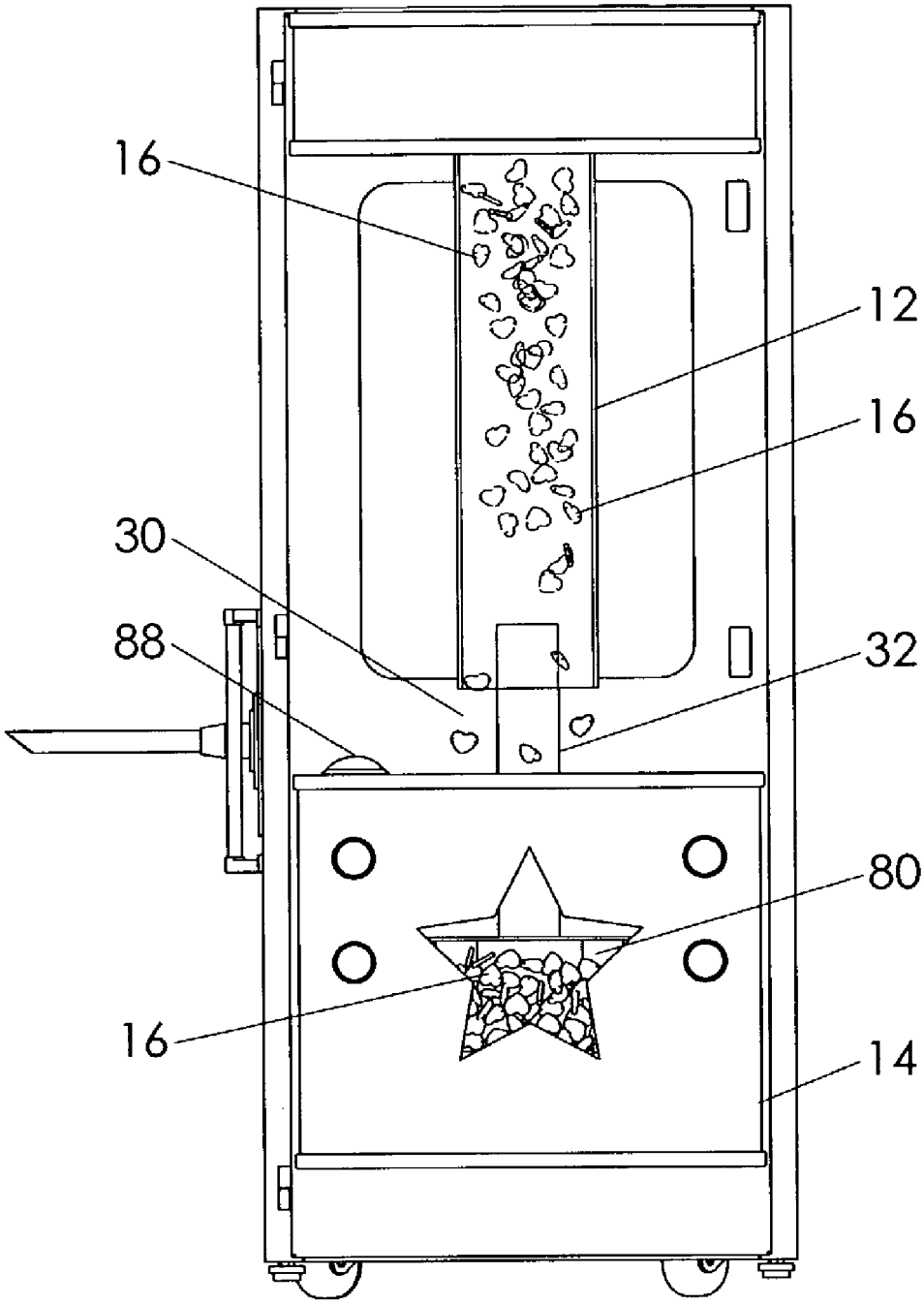
FIG. 8 shows a front perspective view of the charm display machine attached to a stuffing machine.
Figure 9:
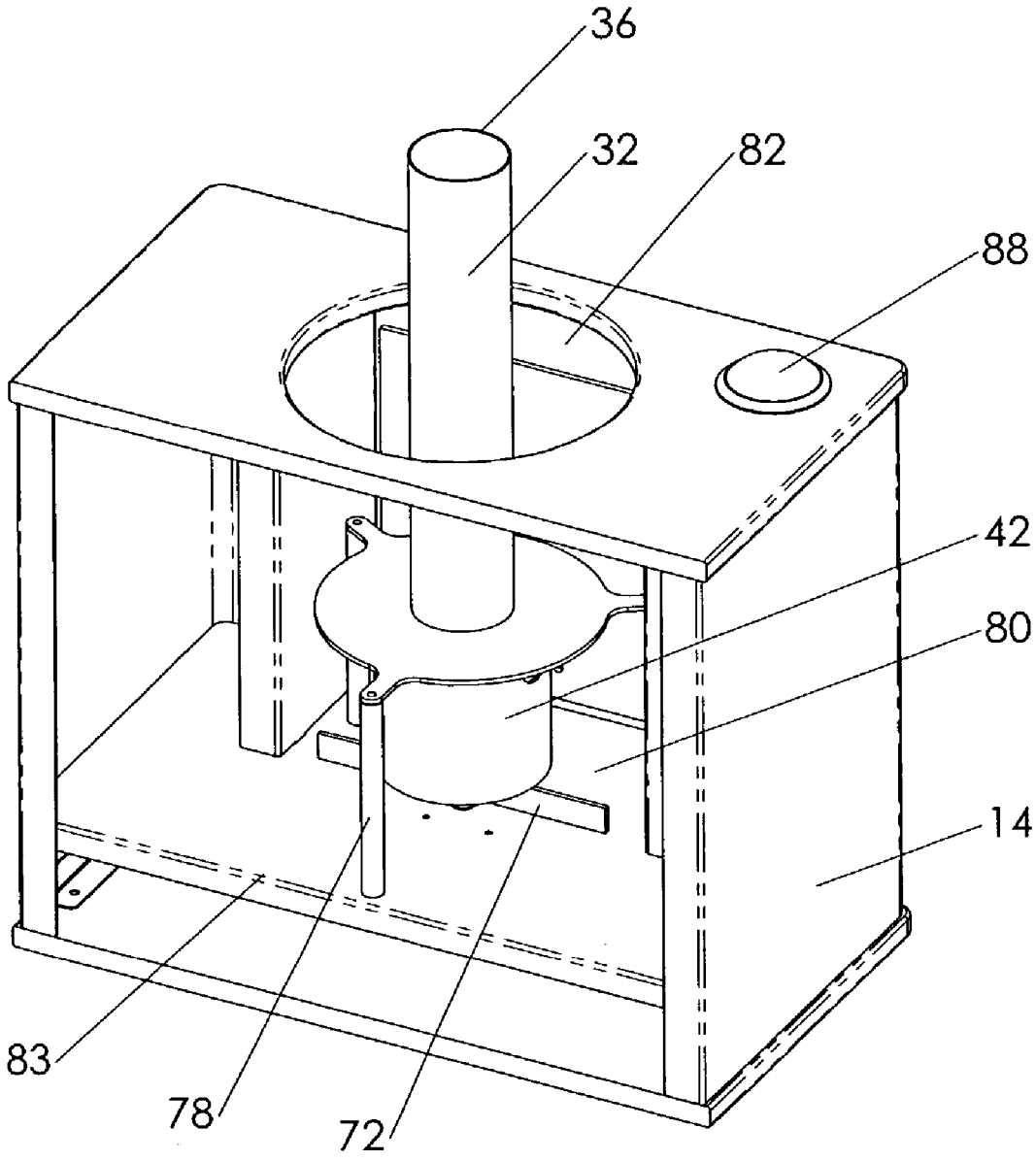
FIG. 9 shows an internal view of the charm hopper with the hopper cover removed further showing the inner exhaust tube, charm hopper opening, hopper base, flow generator assembly, agitator, and venturi air supply line.
Figure 10:
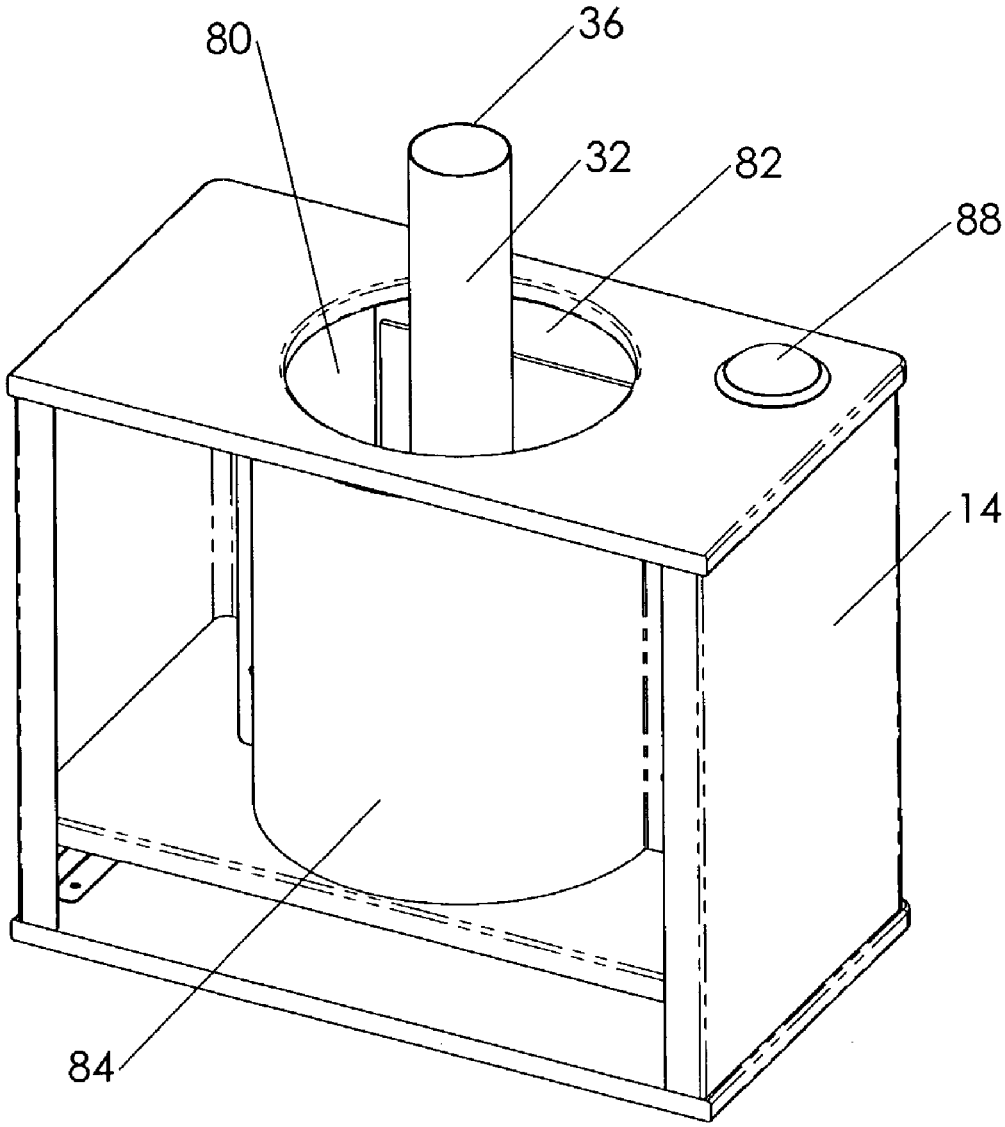
FIG. 10 shows an external view of the charm hopper showing the charm hopper.
Figure 11:
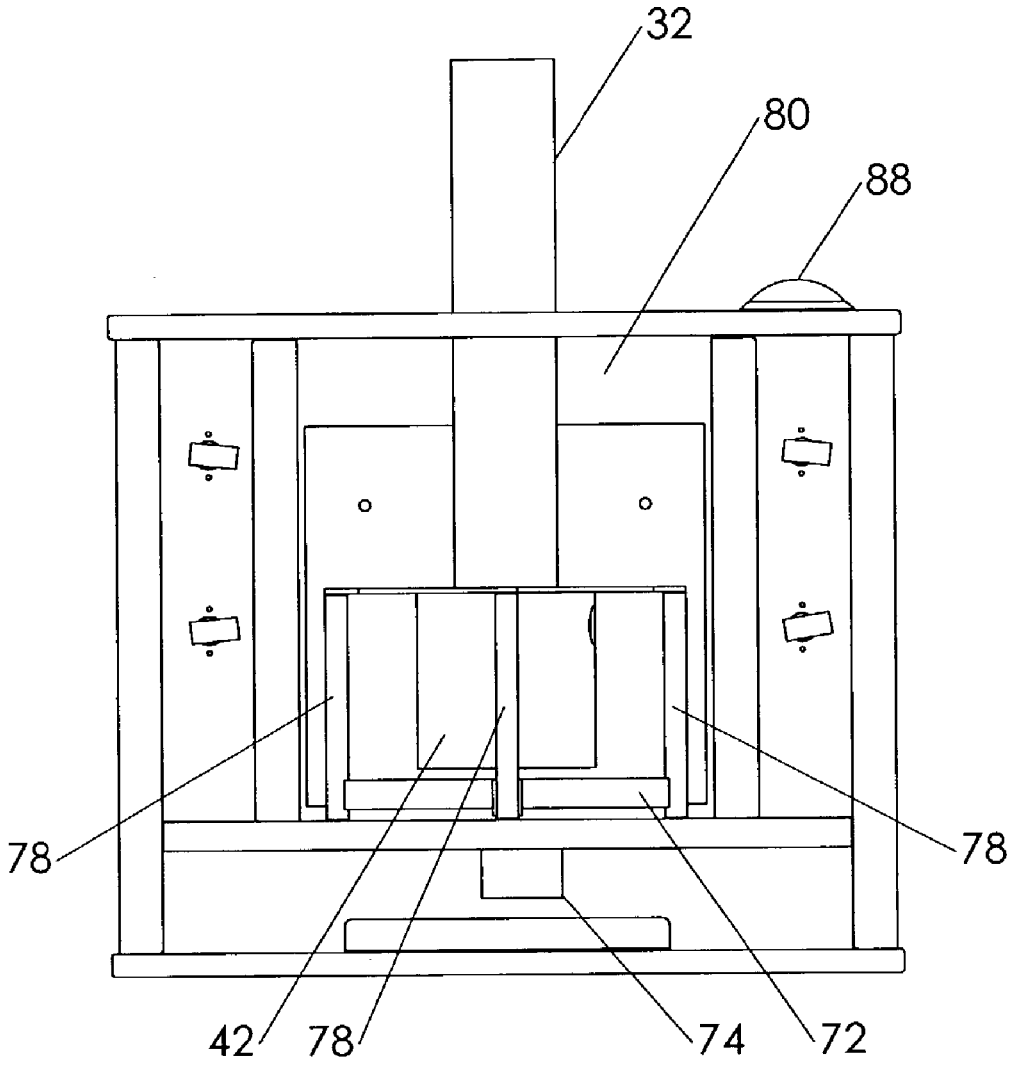
FIG. 11 shows a plan view of the agitator motor and charm hopper base with the hopper cover removed.
Figure 12:
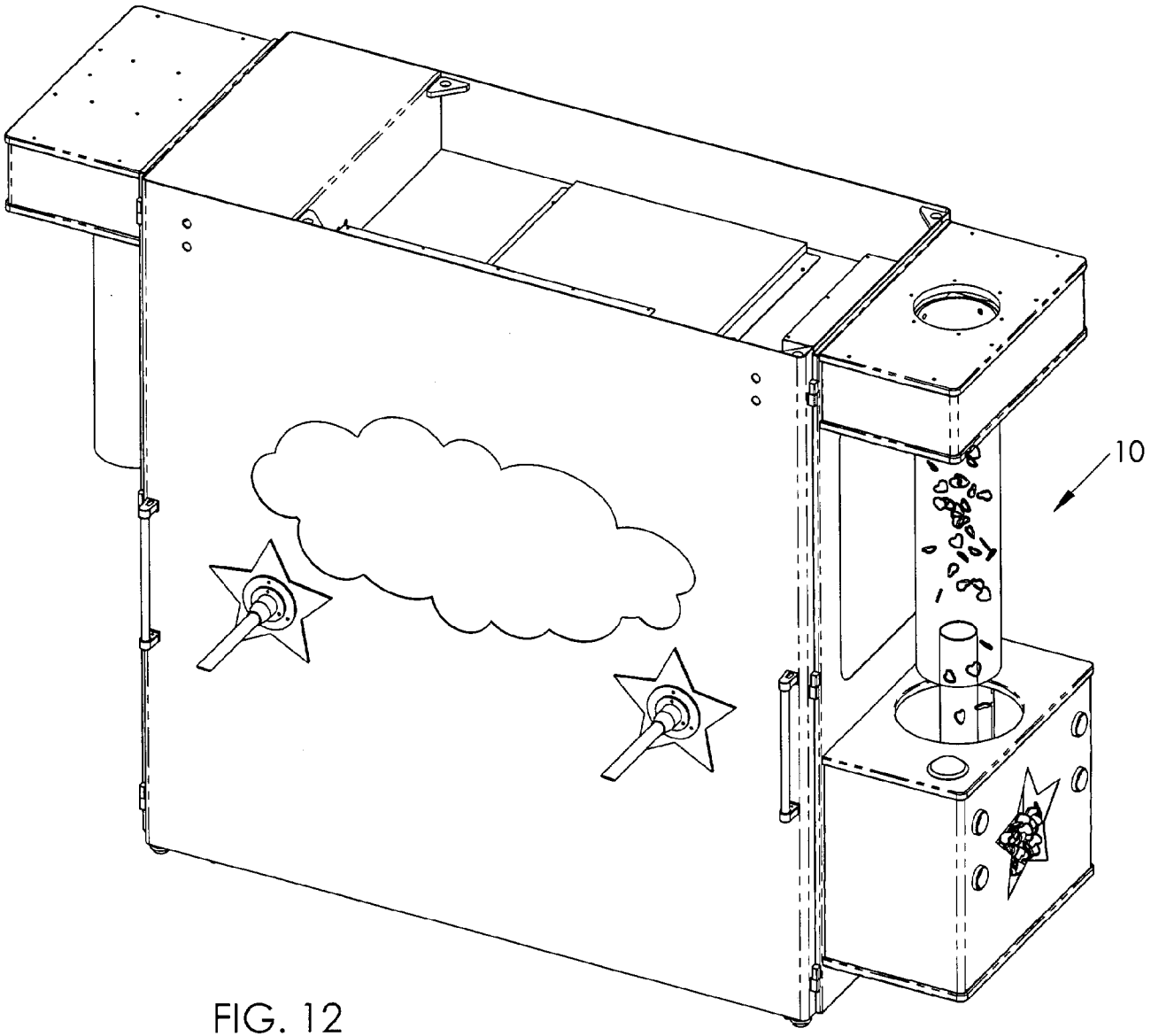
FIG. 12 shows a perspective view of an energized charm display machine attached with a stuffing machine showing charms or hearts fluttering in the outer exhaust tube.
Figure 13:
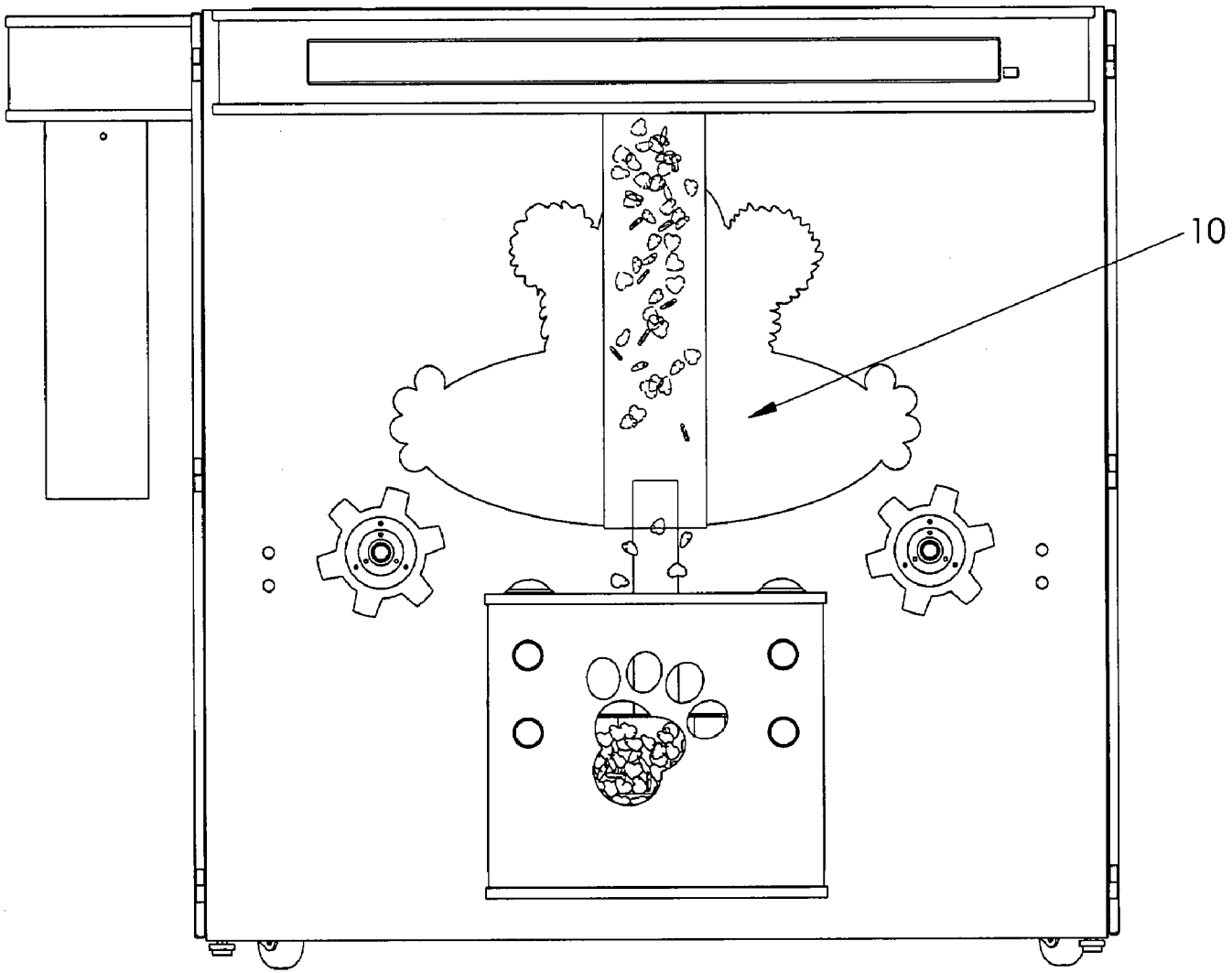
FIG. 13 shows another perspective view of an energized charm display machine attached with a stuffing machine showing the outer exhaust tube, inner exhaust tube, charm hopper, control switches, charms or hearts stored in the charm hopper, and fluttering charms.
Figure 14:
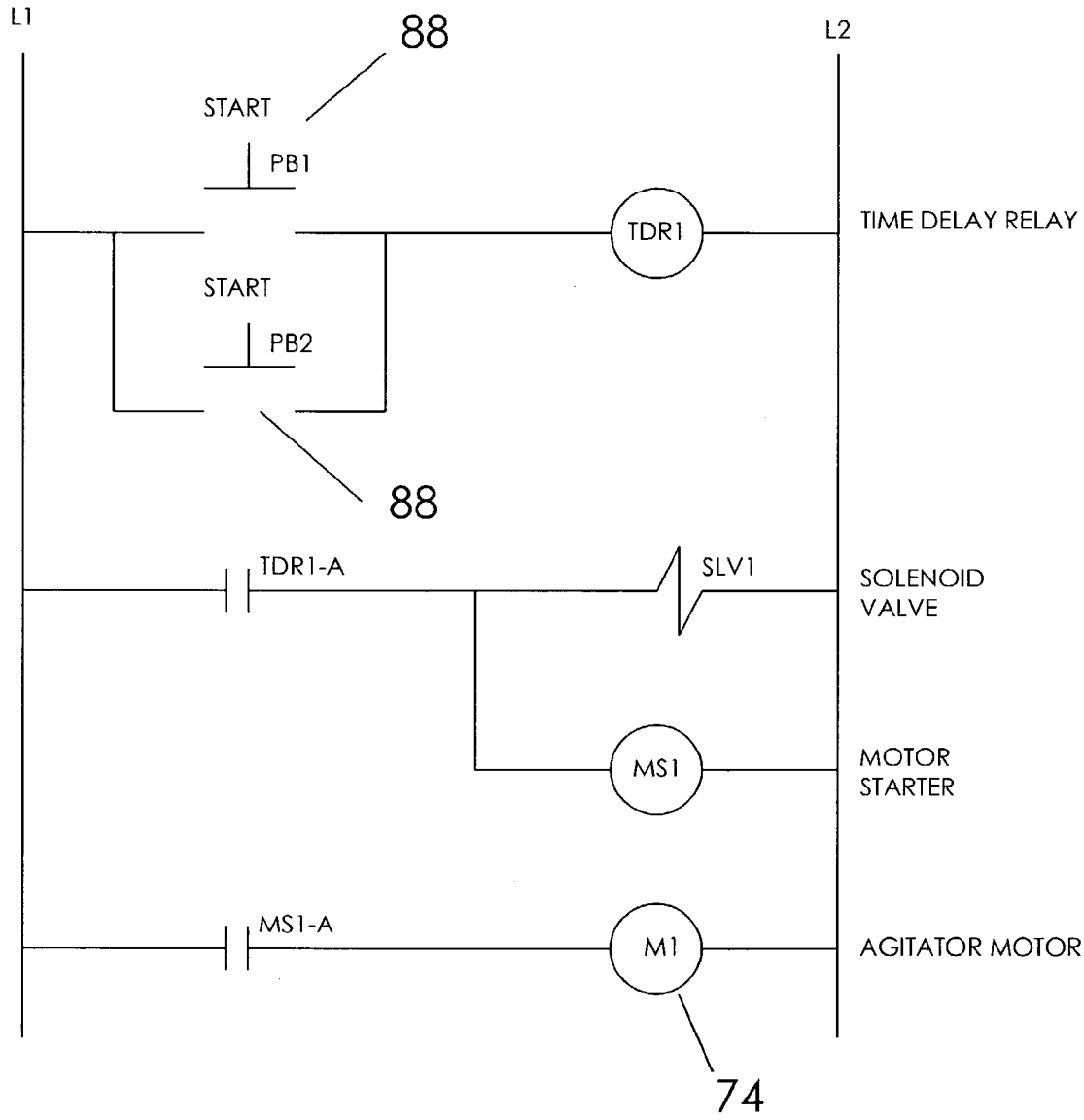
FIG. 14 shows an electrical schematic for the charm display machine and apparatus.
Figure 15:
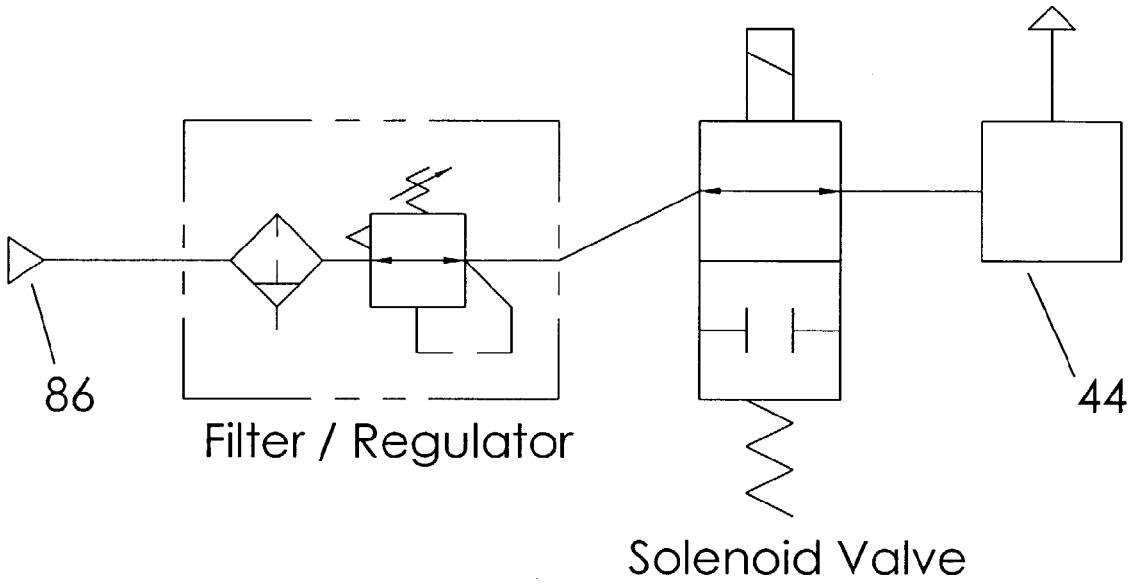
FIG. 15 shows a pneumatic schematic for the charm display machine and apparatus.

Referring now to the drawings, there is shown in the figures a charm display apparatus or machine and its associated components and function. The drawings show the charm display apparatus 10 comprising in an embodiment an outer exhaust tube 12, preferably of a clear transparent or translucent material, an inner exhaust tube 32 which feeds the outer exhaust tube 12, a flow generator assembly 42, and a charm hopper receptacle 80 having an open top 82 which substantially surrounds said flow generator assembly 42. Said flow generator assembly 42 comprises a venturi 44 having a pressurized air inlet 50, a deflection plate 56, an inlet tube 62, and an agitator assembly 70 comprising an agitator 72 and motor 74. All of the aforementioned are mounted as further described on or with a display stand 14. Preferably said charm hopper receptacle 80 has a removable cover plate 84 which forms a portion of said hopper 80 geometry. The outer exhaust tube 12 is preferably cylindrical in shape and has a first outer exhaust tube end 18, a second outer exhaust tube end 20, and an interior diameter greater than an exterior diameter of the inner exhaust tube 32. Preferably, said outer exhaust tube 12 lengthwise axis is mounted in a vertical orientation which is substantially parallel with the gravitational force. The charms or hearts 16 are blown into said outer exhaust tube 12 toward said second exhaust tube end 20 from said inner exhaust tube 32 and flutter downward due to the effect of gravity. The length of the outer exhaust tube 12 is sufficient to provide a display area 17 to view "fluttering" charms 16. When pressurized, the charms or hearts 16 generally cannot reenter the inner exhaust tube 32 due to the positive air flow pressure exiting therefrom. As aforesaid, the outer exhaust tube 12 is preferably cylindrical with a circular cross section and transparent, alternative embodiments may incorporate cross sections of various open or closed polygonal forms and of various levels of transparence or translucence, without departing from the scope of the present art.

The second outer exhaust tube end 20 is preferably vented to atmosphere through a screened exhaust opening 22 which prevents said charms or hearts 16 from exiting said second outer exhaust tube end 20. Said screened exhaust opening 22 further allows exhaust air to escape from the top or second end 20 of said outer exhaust tube 12 rather than the bottom or first end 18. This promotes fluttering of said charms 16 in the upstream air path and further allows said charms 16 to fall out due to gravitational force rather than be forced downward by a return airflow. Alternative embodiments may substitute holes, slots, openings, or negative vacuum pressure for said screened exhaust opening 22 without departing from the scope of the present art. The outer exhaust tube 12 is preferably held at said second outer exhaust tube end 20 by said display stand 14 via the use of fasteners, adhesives, screws, bolts, rivets, or other fastening methods. Alternative embodiments may hold said outer exhaust tube 12 at any location or in any fashion provided the holding method does not interfere with the operation herein described.

The first outer exhaust tube end 18 is preferably mounted above the charm hopper opening 82 whereby a child may manually catch a charm or heart 16 as it flutters downward toward the charm hopper opening 82. That is, the opening or gap 30 between the first outer exhaust tube end 18 and the charm hopper opening 82 allows a child to safely insert a hand and catch a falling charm or heart 16 as it flutters downward under gravitational force. Charms or hearts 16 which are not manually captured at said opening or gap 30 fall through said charm hopper opening 82 and back into the charm hopper 80 whereby they begin the process of being re-blown into the outer exhaust tube 12.

The inner exhaust tube 32 is preferably cylindrical in shape and has a first inner exhaust tube end 34, a second inner exhaust tube end 36, and an exterior diameter less than the interior diameter of the outer exhaust tube 12. Preferably, said inner exhaust tube 32 lengthwise axis is mounted in a vertical orientation which is somewhat or substantially parallel with the axis of said outer exhaust tube 12. Said second inner exhaust tube end 36 is preferably positioned slightly within said first outer exhaust tube end 18, but may be placed substantially within or outside said outer exhaust tube 12 provided said charms or hearts 16 enter said outer exhaust tube 12 due to the positive pressure from said inner exhaust tube 32. The inner exhaust tube 32 is preferably cylindrical with a circular cross section, alternative embodiments may incorporate cross sections of various open or closed polygonal forms, without departing from the scope of the present art. The length of penetration of the inner exhaust tube 32 within said outer exhaust tube 12 allows the pressure of the exhaust air from the flow generator assembly 42 to suspend a quantity of charms 16 in a fluttering type manner.

The first inner exhaust tube end 34 preferably connects with, is fed by, and held by said flow generator assembly 42. Said flow generator assembly 42 is preferably held onto said display stand 14 and within said charm hopper receptacle 80 via legs 78 in a fashion which allows a gap 76 between said flow generator assembly 42 and a base 83 of said charm hopper 80. This gap 76 allows for charms or hearts 16 which fall into said charm hopper 80 to be suctioned into said flow generator assembly 42 and re-enter the display process. Numerous other methods of positioning and holding said flow generator assembly 42 within or external to said charm hopper 80 are possible without departing from the scope of the present art.

In the preferred embodiment, the output end 48 of the venturi 44 feeds the first inner exhaust tube end 34 with a pressurized air and charm/heart 16 flow combination. The aforesaid venturi 44 is recognized in the art as having an input end 46, an output end 48, and a pressurized air inlet 50 which feeds or activates the venturi 44. When pressurized, the pressurized air inlet 50 feed causes volume air flow from the input end 46 through the venturi 44 and out the output end 48, thereby creating a vacuum or suction at said input end 46 to collect and retrieve charms or hearts 16 for entry into the air flow stream. The venturi 44 is mounted within said flow generator assembly 42 preferably between an inlet tube 62 and a deflection plate 56. Said first end 34 of said inner exhaust tube 32 preferably mounts upon a second side 60 of said deflection plate 56 and said output end 48 of said venturi 44 preferably mounts upon a first side 58 of said deflection plate 56. Alternative mountings are acceptable provided said output end 48 of said venturi 44 feeds said inner exhaust tube 32. A second end 66 of said inlet tube 62 also preferably mounts upon said first side 58 of said deflection plate 56 and sandwiches and holds said venturi 44 in contact with said deflection plate 56. Preferably said inlet tube 62 has fingers, indents, reduced interior diameter portions 68, or other mechanisms which contact and hold said venturi 44. Apart from said mechanisms, said inlet tube 62 interior diameter is greater than the outside diameter of said venturi 44. A first end 64 of said inlet tube 62 is the location whereby charms or hearts 16 enter the flow generator assembly 42. That is, said first end 64 of said inlet tube 62 forms the upper portion of the gap 76 between said flow generator assembly 42 and the base 83 of said charm hopper 80.

Within the aforesaid gap 76 between said flow generator assembly 42 and the base 83 of said charm hopper 80 is preferably placed an agitator assembly 70. Said agitator assembly 70 slowly rotates to minimize the possibility of charms or hearts 16 clogging the aforesaid gap 76. In the preferred embodiment said agitator assembly 70 comprises an agitator 72 mounted within said gap 76 which is mounted upon the shaft of a motor 74, preferably gear reduced, mounted beneath said charm hopper base 83 and outside of said charm hopper 80 with said shaft protruding into said charm hopper 80. Alternative embodiments may not utilize said agitator assembly 70, or may place said agitator 72 and motor 74 at different locations, or may utilize other methods to prevent clogging of said gap 76 such as vibrating mechanisms, screening mechanisms, or blowing mechanisms without departing from the present art. Said agitator assembly 70 further provides a feed mechanism for said flow generator assembly 42.

Alternative embodiments of the present invention feed said venturi 44 pressurized air inlet 50 with a low pressure and high volume air supply provided by a turbine source. Traditionally a venturi 44 as utilized in the present art is fed with an air compressor. Said air compressors provide the high pressure pneumatic supply 86 necessary to operate said venturi 44 but are bulky, heavy, and often require specialized power such as three phase or 220 volt. The alternative embodiment of the present art modifies the feed holes and said pressurized air inlet 50 within said venturi 44 to operate said venturi 44 with a pneumatic supply which is low pressure, typically under 15 p.s.i., but provides a high volume air flow. The aforesaid modification enlarges the feed holes within said venturi 44 to allow high air flow with a minimum of source pressure. The feed holes are located within the venturi cavity 52 between the input end 46 and output end 48 and positioned to blow air toward the output end 48, thereby creating a vacuum or suction at the input end.

The aforesaid turbine source is commercially available from many sources and typically comprises a rotary vane turbine which is driven by a very high rpm motor. The turbine source supplies a very large volume of air but at a relatively low pressure. Nevertheless, it provides said air in a small, lightweight, package which typically utilizes conventional 120 volt AC power. Prior to the present art, the venturi 44 systems described have not been coupled with a turbine air supply due to the low pressures provided. With the aforesaid modification, the present art device energizes said venturi 44 with the low pressure high volume air supplied by said turbine, all in a smaller, lighter, and more convenient package.

In operation a person presses an energizing button 88 which energizes an electropneumatic valve which allows compressed air to flow to said venturi 44. (The present invention presupposes an available supply of compressed air.) Said button also energizes said motor 74 and begins operation of the agitator assembly 70. Once fully energized, the venturi 44 suctions charms or hearts 16 from said charm hopper 80 and blows them into said inner exhaust tube 32, thereby allowing the charms or hearts 16 to enter the outer exhaust tube 12 with a velocity great enough to approach said second outer tube end 20. As said charms or hearts 16 lose velocity, they begin to fall under the influence of gravity in a fluttering fashion. A person may collect one or more charms or hearts 16 at the gap 30 between charm hopper opening 82 and the first outer tube end 18 when energized. If not collected, the charms or hearts 16 enter the charm hopper 80, are collected, and re-enter the flow generator assembly 42 to repeat the aforesaid process. An alternative embodiment incorporates a timer on said electropneumatic valve and motor 74 which typically limits operation to approximately seven seconds when energized. Further alternative embodiments auto cycle the aforesaid to create an attention getting display. When de-energized, the fluttering charms 16 fall or drop from the outer exhaust tube 12 into the charm hopper 80. Still further alternative embodiments may incorporate lighting into said outer exhaust tube 12 to help illuminate the charms or hearts 16.

As described, the charm display machine 10 and its associated apparatus functions as an interactive display for presentation of the charms or hearts 16 to the person collecting them. The aforesaid components are sized and designed to minimize the possibility of clogging or jamming of the charms or hearts 16. This includes the gap 76 between the first end 64 of the inlet tube 62 and the hopper base 83, the recessed venturi 44 input, and the motor 74 driven agitator 72. The recessed venturi 44 input end 46 relative to the first end 64 of the inlet tube 62 further creates an air gap which facilitates air flow and reduces clogging or jamming at the venturi 44 inlet. The motor 74 driven agitator 72 sweeps the gap 76 between the inlet tube 62 first end and the charm hopper bottom 83, thereby clearing any clogged or jammed charms 16 in this area. The deflection plate 56 also restricts flow of charms to the agitator 72 which helps reduce the agitator 72 load. Although a venturi 44 is the preferred method and apparatus of providing the air flow stream for movement and levitation of said charms 16, numerous other pneumatic methods may be utilized without departing from the scope of the present art. That is, a pneumatic air shower or blast may be placed at or near the charm hopper base 83 which creates an air stream in which the charms 16 are moved, accelerated, or levitated. Further alternative embodiments may place a suction apparatus near or at the second inner exhaust tube end 36 and thereby suction the charms 16 from said hopper 80. Still further embodiments may form a venturi within said inner exhaust tube 32 in order to create the suction and discharge features.

Further alternative embodiments may utilize the flow generator assembly 42 to inject said charms 16 into the outer exhaust tube 12 without the aid of an inner exhaust tube 32 or may use a shortened inner exhaust tube 32. Additional alternative embodiments may position the inner 32 and outer 12 exhaust tubes in such a fashion that the charms 16 are actually blown or moved toward the opening or gap 30 instead of falling under the influence of gravity. This alternative embodiment would allow charms 16 which exit said outer exhaust tube 12 to be collected in said charm hopper 80 either through the force of gravity or via the movement imparted by the flow generator assembly 42. Said opening or gap 30 may be solely within or attached with said outer exhaust tube 12 or may be between the charm hopper 80 and said outer exhaust tube 12 in further alternative embodiments. Although the preferred embodiment utilizes an outer 12 and inner 32 exhaust tube having substantially vertical orientation, further alternative embodiments may utilize outer 12 or inner 32 exhaust tubes having a plurality of orientations, provided the charms 16 are able to be collected in said charm hopper 80 and re-introduced into said outer exhaust tube 12. Still further embodiments may limit the transparency or translucence of the outer exhaust tube 12 to only a portion of said tube 12.

A further alternative embodiment may utilize the outer exhaust tube 12 to move said charms 16 from the flow generator assembly 42 and vent said charms 16 to atmosphere whereby said charms 16 flutter and fall into the charm hopper 80 outside of the confines of a tube. Is this alternative embodiment, said outer exhaust tube 12 may have a plurality of lengths to perform the aforedescribed function. That is, the outer exhaust tube 12 may be shortened to comprise simply the output end or port of the flow generator assembly 42 or it may have a substantial length which directs the moving charms 16 to a director or deflector which focuses said charms 16 for proper flutter or falling placement into said hopper 80. In this embodiment, the opening or gap 30 may be of substantial length and between the second outer exhaust tube end 20 and the charm hopper 80 opening 82.

From the foregoing description, those skilled in the art will appreciate that all objects of the present invention are realized. A charm display apparatus and method of charm display is shown and described. The machine or apparatus is particularly adapted for uniquely displaying and easily accessing charms.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A charm display apparatus comprising:

an outer exhaust tube having a first end and a second end, a flow generator assembly having a venturi, said venturi having an input end and an output end, and a charm hopper having a base and an opening whereby one or more charms may be placed into said hopper, said charm hopper capable of holding said one or more charms;

said flow generator assembly capable of moving said charms into said outer exhaust tube from said charm hopper, and said outer exhaust tube positioned to accept said moving charms into said exhaust tube, and said outer exhaust tube positioned to allow said charms which exit from said exhaust tube to be collected in said charm hopper; and an opening between said outer exhaust tube and the charm hopper opening whereby a person may retrieve one or more of said charms; and an inner exhaust tube having a first end and a second end, said first end of said inner exhaust tube positioned with the output end of said venturi of said flow generator assembly whereby charms may be fed into said inner exhaust tube; and said second end of said inner exhaust tube positioned near said outer exhaust tube whereby said charms fed into said inner exhaust tube feed into said outer exhaust tube; and said flow generator assembly further having an agitator assembly positioned within said charm hopper comprising an agitator which slowly rotates and clears a gap between a first end of an inlet tube mounted with said flow generator assembly and the charm hopper base, thereby clearing any clogged or jammed charms.

2. A charm display apparatus comprising:

an outer exhaust tube having a first end and a second end, a flow generator assembly having a venturi, said venturi having an input end and an output end, and a charm hopper having a base and an opening whereby one or more charms may be placed into said hopper, said charm hopper capable of holding said one or more charms;

said flow generator assembly capable of moving said charms into said outer exhaust tube from said charm hopper, and said outer exhaust tube positioned to accept said moving charms into said exhaust tube, and said outer exhaust tube positioned to allow said charms which exit from said exhaust tube to be collected in said charm hopper; and an opening between said outer exhaust tube and the charm hopper opening whereby a person may retrieve one or more of said charms; and said venturi having said input end and said output end, whereby pneumatic activation of said venturi causes charms to be suctioned from said hopper at said input end and blown into said outer exhaust tube from said output end; and said flow generator assembly further having a deflection plate having a first side and a second side; and said flow generator assembly further having an inlet tube having a first end, a second end, and a reduced diameter portion, said reduced diameter portion substantially contacting said venturi; and said first side of said deflection plate connected with at least a portion of said second end of said inlet tube; and said deflection plate configured to allow said charms to be blown into said outer exhaust tube from said venturi output end; and said first end of said inlet tube configured to allow said charms to pass into said input end of said venturi.

3. The charm display apparatus as set forth in claim 2, said flow generator assembly further comprising:

an agitator assembly having an agitator and motor, said agitator positioned in a gap between said base of said charm hopper and said first end of said inlet tube whereby said agitator facilitates feeding of said charms into said input end of said venturi.

4. A charm display apparatus comprising:

an outer exhaust tube having a first end and a second end, an inner exhaust tube having a first and a second end, a flow generator assembly having a venturi, said venturi having an input end and an output end, and a charm hopper having a base and a substantially open top whereby one or more charms may be placed into said hopper, said charm hopper capable of holding said one or more charms; and some or all of said outer exhaust tube is substantially transparent, thereby forming a display area; and said outer exhaust tube positioned substantially vertically with a lengthwise axis substantially parallel with a gravitational force, whereby said first outer exhaust tube end is at a lower level than said second outer exhaust tube end and at least partially over said open top of said charm hopper and thereby forming an opening between said first outer exhaust tube end and said open top of said charm hopper; and a screened exhaust opening positioned at said second outer exhaust tube end whereby air within said outer exhaust tube may vent to atmosphere but said charms within said outer exhaust tube may not exit said second end but instead must exit said first outer exhaust tube end due to the effect of said gravitational force; and said first inner exhaust tube end substantially connected near said output end of said venturi of said flow generator assembly and said second inner exhaust tube end positioned near said first outer exhaust tube end; and some or all of said flow generator assembly located within said charm hopper and capable of moving said charms from said input end of said venturi of said flow generator assembly, through said inner exhaust tube and into said outer exhaust tube from said charm hopper, said charms thereby exiting said first outer exhaust tube end due to the effect of said gravitational force and falling through said opening and into said charm hopper, whereby one or more of said charms may be collected at said opening; and a display stand holding one or more of said outer exhaust tube, said inner exhaust tube, said flow generator assembly, or said charm hopper; and said venturi having a pressurized air inlet and mounted with said flow generator assembly; and said venturi input end and said venturi output end substantially located with said flow generator, whereby pneumatic pressure fed into said pressurized air inlet creates a suction effect at said input end and a positive pressure flow at said output end, thereby suctioning charms from said hopper and pneumatically directing said charms into said inner exhaust tube to effectuate said moving of said charms.

5. The charm display apparatus as set forth in claim 4, said flow generator assembly further comprising:

an agitator assembly between said flow generator assembly and said base of said charm hopper.

* * * * *